US007174125B2

(12) United States Patent
Yamasaki

(10) Patent No.: US 7,174,125 B2
(45) Date of Patent: Feb. 6, 2007

(54) IMAGE FORMING APPARATUS

(75) Inventor: Naoya Yamasaki, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 223 days.

(21) Appl. No.: 11/055,514

(22) Filed: Feb. 11, 2005

(65) Prior Publication Data

US 2006/0062617 A1 Mar. 23, 2006

(30) Foreign Application Priority Data

Sep. 21, 2004 (JP) ..... 2004-274160

(51) Int. Cl.
*G03G 15/00* (2006.01)
*G03G 15/24* (2006.01)
*B41F 1/54* (2006.01)

(52) U.S. Cl. ..... 399/384; 399/148; 399/154; 399/179; 399/205; 101/185; 101/483; 101/484

(58) Field of Classification Search ..... 399/384, 399/148, 154, 179, 205; 101/185, 483, 484
See application file for complete search history.

(56) References Cited

U.S. PATENT DOCUMENTS 4,882,778 A * 11/1989 Hosaka et al. ..... 700/82
6,061,533 A * 5/2000 Kajiwara ..... 399/49
6,301,023 B1 * 10/2001 Hirai et al. ..... 358/498
6,930,786 B2 * 8/2005 Kataoka et al. ..... 358/1.12
2005/0089340 A1 * 4/2005 Yamamoto ..... 399/49

FOREIGN PATENT DOCUMENTS

JP B2-3317908 6/2002

* cited by examiner

*Primary Examiner*—Ren Yan
*Assistant Examiner*—Marvin P Crenshaw
(74) *Attorney, Agent, or Firm*—Oliff & Berridge, PLC

(57) ABSTRACT

An image forming apparatus of the invention at least includes: a transport control component for controlling a transporting component so that transporting of the continuous paper is stopped when a print job is finished, the continuous paper is back-transported to an image formation start position of the next print job, and after that, the continuous paper is transported again; and a control component that, when a print job is executed in the case where a pattern image exists in a back-transported area which is set after the continuous paper is back-transported, controls the image formation controlling component so as not to correct the image formation position.

4 Claims, 9 Drawing Sheets

IMAGE FORMING APPARATUS

CROSS-REFERENCE TO RELATED APPLICATION

This application claims priority under 35 USC 119 from Japanese Patent Application No. 2004-274160, the disclosure of which is incorporated by reference herein.

BACKGROUND OF THE INVENTION

1. Field of the Invention

The present invention relates to an image forming apparatus and, particularly, to an image forming apparatus for forming an image on a continuous paper.

2. Description of the Related Art

There is a conventionally known tandem-type image forming apparatus for forming toner images of plural colors of yellow, magenta, cyan, and black on plural image carrying members arranged along a continuous paper transporting path and for transferring the formed toner images of the plural colors on the image carrying members onto a continuous paper being transported to the apparatus such that they are overlaid, thereby forming an image on a continuous paper.

In such an image forming apparatus, a technique is known in which before an image based on each set of image data included in a print job is formed, pattern images of the different colors corresponding to each of the sets of data image data of the print job are formed on a continuous paper and, on the basis of a correction amount computed based on the result of detection of a shift amount of the formed pattern images of each of the colors, an image formation position for the images of respective colors according to the image data is corrected. In such a manner, images of the plural colors based on the image data can be formed so as to be overlaid on a continuous paper without a color shift by correcting the positional deviations of the images of the colors.

The image forming apparatus has a problem such that when a continuous paper is also transported continuously between print jobs, the continuous paper on which no image is formed is transported before an image based on image data for the next print job is formed, such that a blank area is excessively produced on the continuous paper. To solve such a problem, there is a known technique of back-transporting a print start page of a continuous paper to a position where an image can be formed, and thereafter, forming an image (for example, refer to Patent Publication No. 3,317,908). By applying the technique and back-transporting a continuous paper to an image formation start position for the next print job when a print job is finished, excessive formation of a blank area can be suppressed.

Although excessive formation of a blank area on a continuous paper can be suppressed by back-transporting the continuous paper when a print job is finished by applying the related art, a method of correcting and forming a pattern in a case where a pattern image in a back-transported area is detected has not been considered. In the case of detecting, after the continuous paper is back-transported, a shift amount of a pattern image that is formed before the continuous paper is back-transported and that is already formed on the continuous paper and then correcting the image formation position of each color on the basis of the detected shift amount, a problem occurs of an erroneous correction being made. The erroneous correction occurs when a pattern image of before the continuous paper is back-transported is used in the case where the pattern image forming conditions at the time of forming a pattern image before the continuous paper is back-transported are different from those at the time of forming a pattern image after the continuous paper is back-transported, due to a transport shift of the continuous paper, elongation of the continuous paper, standby time, and the like. A problem also occurs such that when a continuous paper is back-transported without considering the pattern image position before the continuous sheet is back-transported, and then forming a pattern image, pattern images overlap each other and an erroneous correction is made.

SUMMARY OF THE INVENTION

The present invention has been made in view of the above circumstances and provides an image forming apparatus.

An image forming apparatus according to a first aspect of the invention to achieve the above-described object includes: a transporting component for transporting a continuous paper at a predetermined transport speed; plural image forming components which are arranged along the transport direction of the continuous paper transported by the transporting component and sequentially form images of respective colors based on image data included in a print job on the continuous paper being transported; a pattern image forming component for controlling the image forming components such that pattern images of respective colors are formed on the continuous paper being transported; a correction amount computing component for detecting a shift amount of at least one of the position and the density of the pattern images of the different colors formed on the continuous paper during transporting and computing a correction amount for correcting at least one of a formation position and density of images of the different colors on the basis of the detected shift amount; an image formation controlling component for controlling the image forming components such that at least one of the image formation position and the density is corrected by using the correction amount computed by the correction amount computing component; a transport control component for controlling the transporting component such that transporting of the continuous paper is stopped when a print job is finished, the continuous paper is back-transported to an image formation start position of the next print job, and thereafter, the continuous paper is transported again; and a control component that, when a print job is executed in the case where a pattern image exists in a back-transported area which is set after the continuous paper is back-transported, controls the image formation controlling component so as not to correct at least one of the image formation position and the density or so as to correct at least one of the image formation position and the density by using a correction amount used for the immediately preceding print job.

The plural image forming components of the image forming apparatus of the first aspect are arranged along the transport direction of the continuous paper transported at a predetermined speed by the transporting component and sequentially form images of respective colors based on image data included in a print job on the continuous paper being transported. The pattern image forming component controls the image forming components such that pattern images of respective colors are formed on the continuous paper being transported. The correction amount computing component detects a shift amount of at least one of the position and the density of the pattern images of the different colors formed on the continuous paper during transporting and computes a correction amount for correcting at least one of a formation position and density of images of the different colors on the basis of the detected shift amount. The image formation controlling component controls the image forming components such that the image formation position and density are corrected by using the correction amount of the print job computed by the correction amount computing component. Consequently, images of the colors obtained by correcting at least one of the positional shifts and the density shifts are formed by the image forming components. The transport control component controls the transporting component such that transporting of the continuous paper is stopped when a print job is finished, the continuous paper is back-transported to an image formation start position of the next print job, and thereafter, the continuous paper is transported again. However, in the case of forming a pattern image for correcting the image formation position or density when the print job is finished or of forming only a pattern image since a print image is not formed due to a data transfer delay during the print job, only the pattern image is formed starting at some midpoint on the continuous paper. Consequently, when the continuous paper is back-transported to the image formation start position of the next print job, a pattern image formed before the back-transport of the continuous paper is already formed on the continuous paper. When a print job is executed after the continuous paper is back-transported, the control component controls the image formation controlling component so as not to correct at least one of the image formation position and the density by using the pattern image formed before the continuous paper is back-transported or so as to correct at least one of the image formation position and the density by using a correction amount used for the immediately preceding print job.

As described above, when the transport of the continuous paper is stopped when the print job is finished, the continuous paper is back-transported to the image formation start position of the next print job, and the next print job is executed, and at least one of the image formation position and the density is corrected in accordance with the correction amount computed before the continuous paper is back-transported or the image formation position and density are not corrected. Consequently, even if the pattern image forming conditions change after the continuous paper is back-transported due to elongation of the continuous paper caused by change over time, shift of the continuous paper, or change in the pattern image formation environment, an erroneous correction using the pattern image formed before the continuous paper is back-transported can also be suppressed after the continuous paper is back-transported.

An image forming apparatus according to a second aspect of the invention includes: a transporting component for transporting a continuous paper at a predetermined transport speed; plural image forming components which are arranged along the transport direction of the continuous paper transported by the transporting component and sequentially form images of respective colors based on image data included in a print job on the continuous paper being transported; a pattern image forming component for controlling the image forming components such that pattern images of respective colors are formed on the continuous paper being transported; a correction amount computing component for detecting a shift amount of at least one of the position and the density of the pattern images of the different colors formed on the continuous paper during transporting and computing a correction amount for correcting at least one of a formation position and density of images of the different colors on the basis of the detected shift amount; an image formation controlling component that controls the image forming components such that at least one of the image formation position and the density is corrected by using the correction amount computed by the correction amount computing component; a transport control component that controls the transporting component such that transporting of the continuous paper is stopped when a print job is finished, the continuous paper is back-transported to an image formation start position of the next print job, and thereafter, the continuous paper is transported again; a pattern image formation control component that, when a print job is executed in the case where a pattern image exists in a back-transported area which is set after the continuous paper is back-transported, controls the pattern image forming component such that a pattern image formed after the continuous paper is back-transported and a pattern image formed before the continuous paper is back-transported do not overlap each other; and a computation control component that, after the continuous paper is back-transported, controls the correction amount computing component so as to detect a shift amount of at least one of the position and the density of pattern images formed after the continuous paper is back-transported.

The pattern image forming component of the image forming apparatus of the second aspect controls the image forming components such that a pattern image formed after the transported continuous paper is back-transported and a pattern image formed before the continuous paper is back-transported are formed so as not to overlap each other on the continuous paper being transported. The correction amount computing component detects a shift amount of at least one of the position and the density of the pattern images formed on the continuous paper before and after the back-transport so as not to overlap each other and computes a correction amount on the basis of the detection result. The computation control component controls the correction amount computing component so as to detect a shift amount of a pattern image formed after the continuous paper is back-transported in the back-transported area and to compute the correction amount. The image formation control component controls the image formation component so as to correct the image formation position and the density by using a correction amount corresponding to a print job being executed, which is computed by the correction amount computing component.

As described above, pattern images are formed on the continuous paper so as not to overlap each other after the continuous paper is back-transported, the correction amount is computed for each of the pattern images formed before the continuous paper is back-transported and the pattern images formed after the continuous paper is back-transported, and at least one of the image formation position and the density can be corrected by using the correction amount corresponding to a print job being executed. Consequently, even if the pattern image forming conditions change after the continuous paper is back-transported, at least one of the image formation position and the density can be corrected on the basis of pattern images formed before and after the continuous paper is back-transported, and an erroneous correction can be suppressed.

An image forming apparatus according to a third aspect of the invention includes: a transporting component for transporting a continuous paper at a predetermined transport speed; plural image forming components which are arranged along the transport direction of the continuous paper transported by the transporting component and sequentially form images of respective colors based on image data included in a print job on the continuous paper being transported; a pattern image forming component for controlling the image forming components such that pattern images of respective colors are formed on the continuous paper being transported; a correction amount computing component that detects a shift amount of at least one of the position and the density of the pattern images of the different colors formed on the continuous paper during transporting and computes a correction amount for correcting at least one of a formation position and density of images of the different colors on the basis of the detected shift amount; an image formation controlling component that controls the image forming components such that at least one of the image formation position and the density is corrected by using the correction amount computed by the correction amount computing component; a transport control component that controls the transporting component such that transporting of the continuous paper is stopped when a print job is finished, the continuous paper is back-transported to an image formation start position of the next print job, and thereafter, the continuous paper is transported again; and a back-transport amount control component for controlling the transport control component such that a back-transport amount of the continuous paper according to the presence or absence of a pattern image formed or a pattern image position is set.

In the image forming apparatus according to the third aspect, when a pattern image is formed for correcting the image formation position and density on the continuous paper transported when the print job is finished or only a pattern image is formed without forming a print image due to a data transfer delay during a print job, the back-transport amount of the continuous paper is controlled according to the presence or absence of the pattern image or the pattern image position and the continuous paper is back-transported to the position where there is no pattern image formed before the back-transport of the continuous paper in the area after the back-transport.

By back-transporting the continuous paper to a position where a pattern image formed before the back-transport of the continuous paper and a pattern image formed after the back-transport of the continuous paper do not overlap each other, an erroneous correction caused by overlap of the pattern images or detection of the pattern image formed before the back-transport can be suppressed.

The image forming apparatus of the invention produces the following effect. The transport of the continuous paper is stopped after a print job is finished, and the continuous paper is back-transported to the image formation start position of the next print job. When a pattern image formed before the back-transport of the continuous paper exists in the back-transported area at the time of executing the following print job, at least one of the image formation position and the density is corrected in accordance with the correction amount computed before the back-transport of the continuous sheet or at least one of the image formation position and the density is not corrected. Consequently, even if the pattern image formation conditions change after the continuous sheet is back-transported, an erroneous correction using the pattern image formed before the continuous sheet is back-transported can be suppressed at the time of executing the print job after the continuous sheet is back-transported.

BRIEF DESCRIPTION OF THE DRAWINGS

Preferred embodiments of the present invention will be described in detail based on the following figures, wherein.

DETAILED DESCRIPTION OF THE INVENTION

Embodiments of the present invention will be described below with reference to the drawings.

Figure 1:
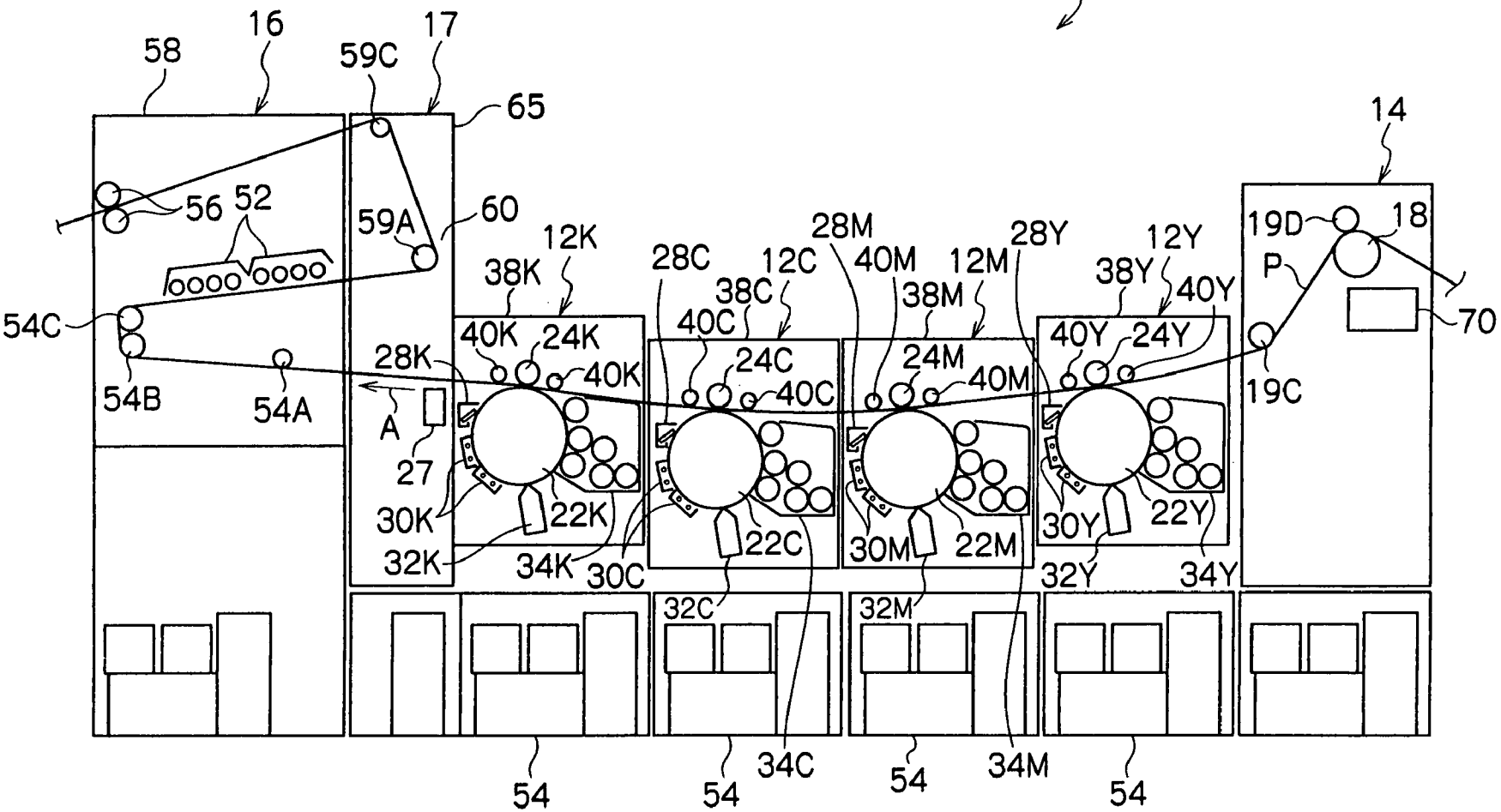
FIG. 1 is a schematic configuration diagram of an image forming apparatus of the invention.

An image forming apparatus 10 has, as shown in FIG. 1, printing components 12Y, 12M, 12C, and 12K for sequentially transferring toner images of yellow (Y), magenta (M), cyan (C), and black (K), respectively, onto a continuous paper P. The printing components 12Y, 12M, 12C, and 12K are disposed in order from the upstream side to the downstream side in the transport direction of the continuous paper P. On the upstream side in the transport direction of the printing component 12Y, a paper supplying component 14 for transporting the continuous paper P to the printing components 12Y, 12M, 12C, and 12K is provided. On the downstream side in the transport direction of the printing component 12K, a fixing component 16 for fixing toner images of the colors transferred by the printing components 12Y, 12M, 12C, and 12K onto the continuous paper P and a paper ejecting component 17 for ejecting the continuous paper P passed through the fixing component 16 are provided.

The paper supplying component 14 has a transport roller 18 over which the continuous paper P rolls. An idle roll 19D is in contact with the transport roller 18. The continuous paper P is sandwiched in the nip between the idle roll 19D and the transport roller 18 and transported to the printing component 12Y via an idle roll 19C.

The printing components 12Y, 12M, 12C and 12K have image carrying members 22Y, 22M, 22C, and 22K, respectively. The image carrying members 22Y, 22M, 22C, and 22K are disposed along the transport path of the continuous paper P.

The printing component 12Y also has a transfer roll 24Y, guide rolls 40Y, a cleaning device 28Y, a charger 30Y, an LED head 32Y, and a developing device 34Y. The charger 30Y charges the image carrying member 22Y uniformly. For example, the charger 30Y applies a negative voltage obtained by adding a negative DC bias voltage to alternating current voltage. The LED head 32Y performs exposure on the image carrying member 22Y uniformly charged by the charger 30Y on the basis of image data of the Y color, thereby forming an electrostatic latent image on the image carrying member 22Y. The developing device 34Y is provided on the upstream side of the LED head 32Y in an image carrying member rotating direction A and forms a toner image of the Y color according to the electrostatic latent image formed on the image carrying member 22Y. To the developing device 34Y is applied a negative development bias voltage obtained by adding the negative DC bias voltage to alternating current voltage. The toner of the Y color is adhered only in an electrostatic latent image formation area on the image carrying member 22Y by the developing device 34Y, thereby forming a toner image made of negatively charged toner particles of the Y color according to the electrostatic latent image on the image carrying member 22Y.

By applying a transfer bias from the transfer roll 24Y to the Y-color toner image formed on the image carrying member 22Y by the developing device 34Y, the toner image made of the negatively charged toner particles is attracted from the image carrying member 22Y to the continuous paper P and is transferred onto the continuous paper P. The cleaning device 28Y scrapes off and removes untransferred residual toner which is not transferred to the continuous paper P and instead remains on the surface of the image carrying member 22Y.

The printing component 12M also has, like the printing component 12Y, the image carrying member 22M, a transfer roll 24M, guide rolls 40M, a cleaning device 28M, a charger 30M, an LED head 32M, and a developing device 34M. The printing component 12C also has, like the printing component 12Y, the image carrying member 22C, a transfer roll 24C, guide rolls 40C, a cleaning device 28C, a charger 30C, an LED head 32C, and a developing device 34C. The printing component 12K also has, like the printing component 12Y, the image carrying member 22K, a transfer roll 24K, guide rolls 40K, a cleaning device 28K, a charger 30K, an LED head 32K, and a developing device 34K. Since the respective configurations of the printing components 12M, 12C, and 12K have functions similar to those of the printing component 12Y, the detailed description will not be repeated.

The toner images of the colors are sequentially transferred onto a continuous paper by the above-described printing components 12Y, 12M, 12C, and 12K and a color image is formed on the continuous paper.

The fixing component 16 has a flash fixing device 52, idle rolls 54A, 54B, and 54C, and paper ejection rolls 56. The continuous paper P running along the idle rolls 54A, 54B, and 54C is transported upside down by the idle rolls 54A, 54B, and 54C. The flash fixing device 52 emits infrared rays onto a color image formation face of the continuous paper P. The toner which is not yet fixed on the continuous paper P is heated and melted by the emitted infrared rays and, thereafter, solidifies, thereby fixing a color image on the continuous paper P. The continuous paper P that has passed through the flash fixing device 52 is transported to the paper ejecting component 17, transported again to the fixing component 16 via idle rolls 59A and 59C, and ejected to outside of the apparatus by the paper ejection rolls 56.

Figure 2:
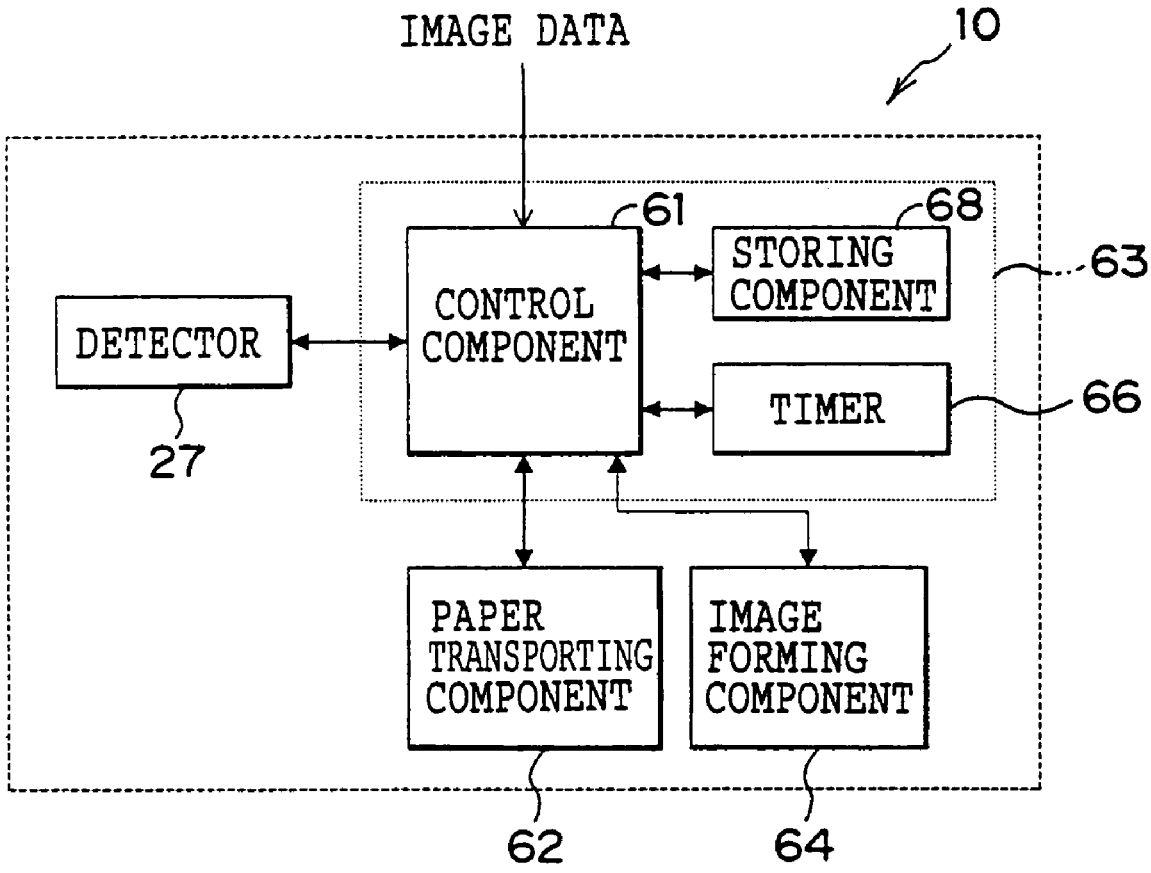
FIG. 2 is a schematic view showing an electric configuration of the image forming apparatus of the invention.

As shown in FIG. 2, the image forming apparatus 10 includes a main controller 63, a paper transporting component 62, an image forming component 64, and a detector 27. The main controller 63 includes a control component 61, a storing component 68, and a timer 66. The control component 61 is connected to the storing component 68, the timer 66, the detector 27, the paper transporting component 62, and the image forming component 64 so as to be able to transmit/receive data and commands. The control component 61 controls the entire image forming apparatus 10 and, mainly, on the basis of image data included in an input print job, controls the paper transporting component 62 and the image forming component 64 such that images of the colors are overlaid on a continuous paper to form a color image on the continuous paper P. The paper transporting component 62 includes a driver component for driving each of the various transporting components which transport a continuous paper such as the idle roll 19D, the transport roller 18, the idle roll 19C, the transfer roll 24Y, the guide rolls 40Y and 40M, the transfer roll 24C, the guide rolls 40C, the transfer roll 24K, the guide rolls 40K, the idle rolls 54A, 54B, and 54C, and the paper ejection roll 56 shown in FIG. 1. The paper transporting component 62 transports a continuous paper at a predetermined speed along the continuous paper transport path in the transport direction or the direction opposite to the transport direction. The image forming component 64 includes the printing components 12Y, 12M, 12C, and 12K. The storing component 68 prestores various kinds of data and a continuous paper back-transport amount of back-transporting of a continuous paper by the paper transporting component 62 in the direction opposite to the transport direction to as far as an image formation start position based on image data of the next print job. Although a predetermined back-transport amount is stored in the embodiment, a value which varies according to image data included in an input print job, a speed for continuous paper transport, and the like may be determined.

Figure 3:
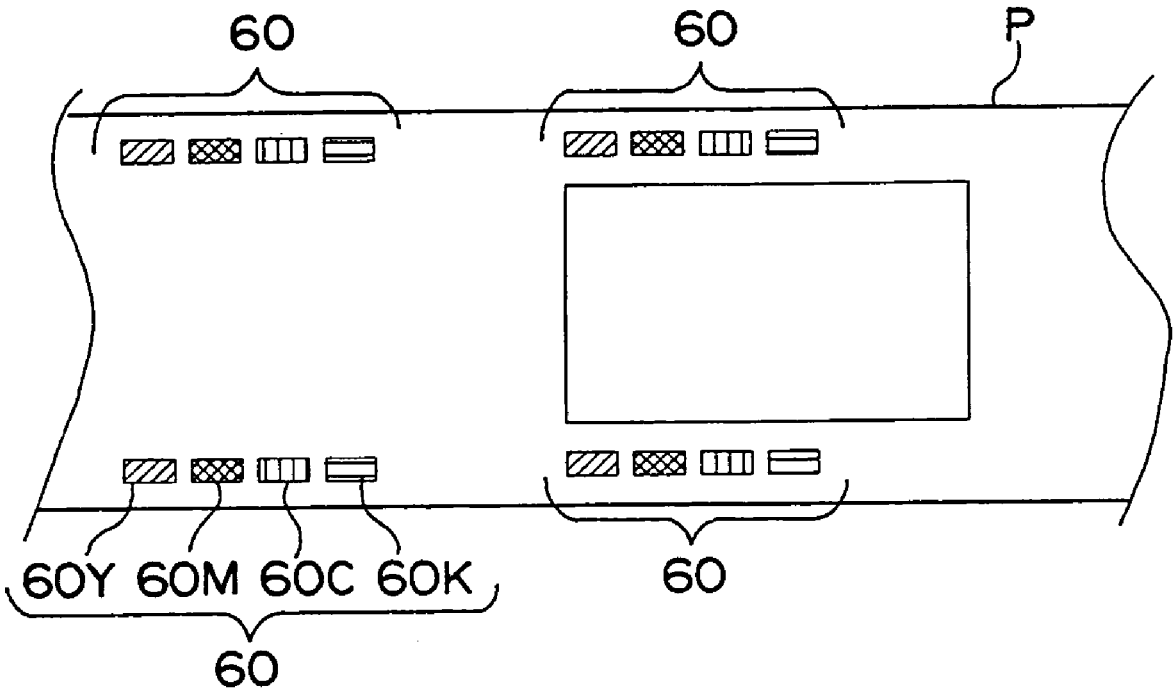
FIG. 3 is a schematic view showing pattern images of plural colors formed on a continuous paper.

In the image forming apparatus 10 of the embodiment, to detect a positional shift of an image of each color, pattern images 60Y, 60M, 60C, and 60K of the respective colors shown in FIG. 3 are formed on the continuous paper P by the printing components 12Y, 12M, 12C, and 12K, respectively, before an image is formed by outputting image data of the respective colors based on image data included in a print job to the LED heads 32Y, 32M, 32C, and 32K. In an ideal state where no positional shift occurs, the pattern images 60Y, 60M, 60C, and 60K are formed at predetermined intervals in the transport direction of the continuous paper P. The pattern images 60Y, 60M, 60C, and 60K are detected by the detector 27 provided on the downstream side in the transport direction of the continuous paper P (refer to FIG. 1).

Figure 4A:
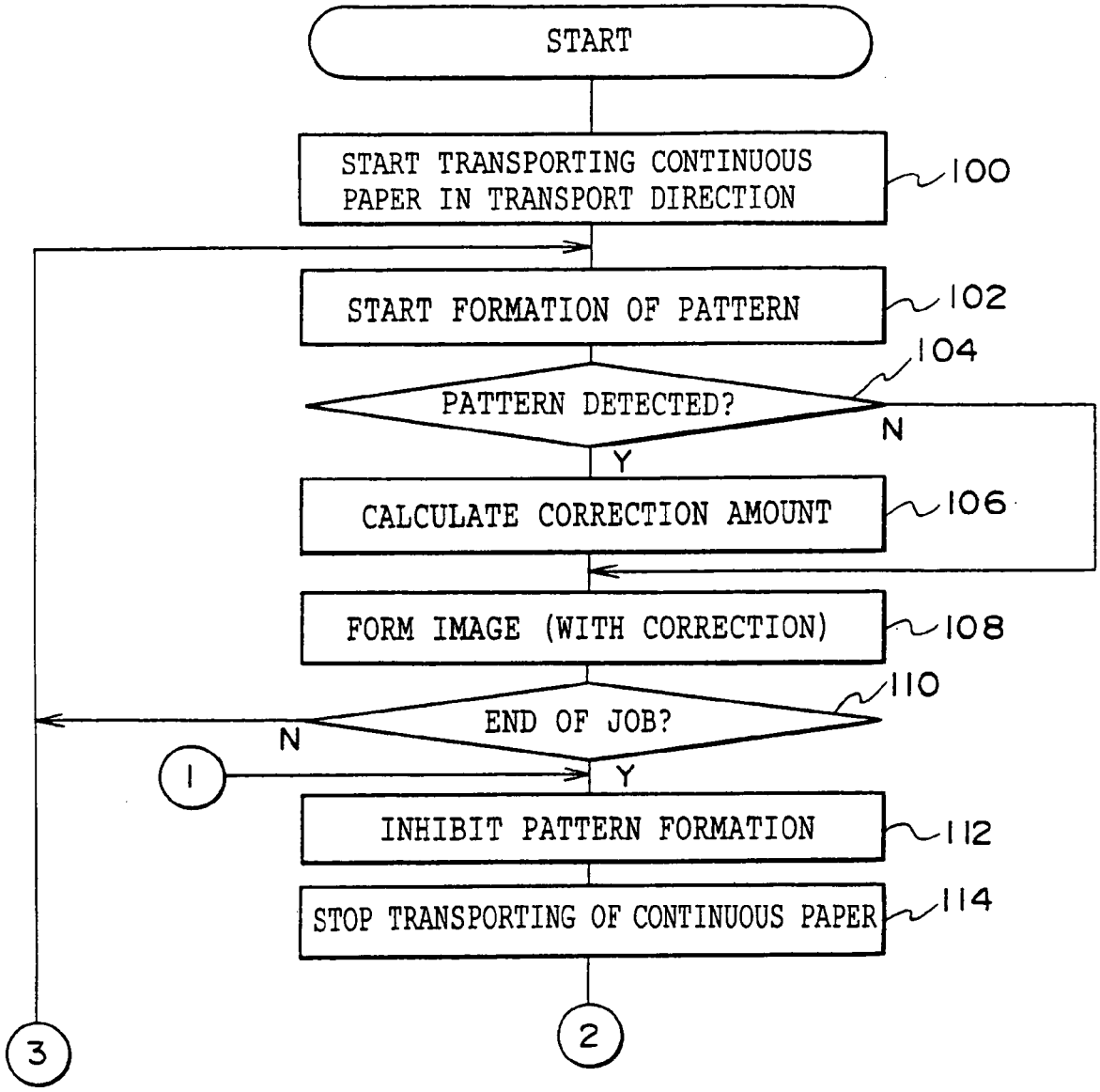
FIGS. 4A and 4B are flowcharts showing the flow of processes executed by a control component of the image forming apparatus of the invention.
Figure 4B:
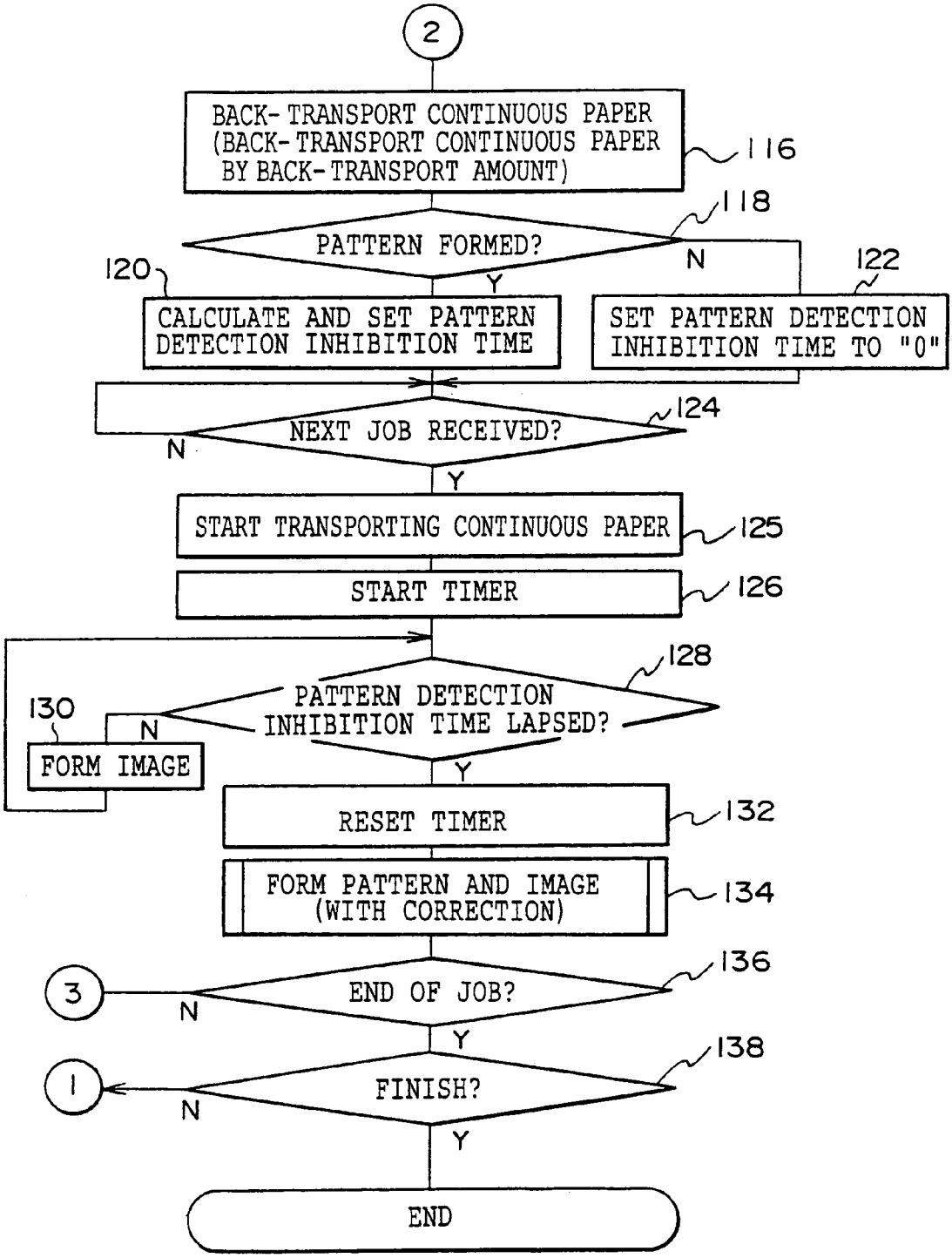

Processes executed by the control component 61 will now be described with reference to FIGS. 4A and 4B. When the power is turned on by a power switch on the image forming apparatus 10 and a print job is received externally, transporting in the transport direction of the continuous paper P starts at step 100.

At step 102, prior to execution of image formation based on the print job, formation of the pattern images 60Y, 60M, 60C, and 60K (hereinafter, also generically referred to as the pattern images 60) starts on the continuous paper P at every predetermined time. As the predetermined time, for example, an interval for formation of a color image of one page, an interval for formation of color images of plural pages, or the like is determined in advance. In such a manner, the pattern image forming process for forming the pattern images 60 on the continuous paper at an interval for forming a color image of one page or an interval for forming color images of plural pages is started with the process of step 102.

At the following step 104, whether a pattern image is detected or not is determined. If the determination is affirmative, the procedure proceeds to step 106. On the basis of detection timings of the pattern images 60Y, 60M, 60C, and 60K, for example, the time up to the detection timing of each of the pattern images 60M, 60C, and 60K is calculated by using the detection timing of the pattern image 60Y of the Y color as a reference. On the basis of the calculated time, a shift amount of the pattern image 60 of each color is detected, and a correction amount for correcting the positional shift of the image of each color is calculated. The correction amount is calculated by, for example, calculating the distance to each of the pattern images 60M, 60C, and 60K using the pattern image 60Y as a reference based on both the time elapsed since the pattern image 60Y is detected until each of the pattern images 60M, 60C, and 60K is detected and the transport speed of the continuous paper P, and calculating the difference between the distance and a distance when there is no positional shift to arrive at a correction amount for correcting the image formation position of each color image.

At step 108, by correcting the timing for forming an electrostatic latent image of each color on the basis of the correction amount calculated at step 106, the image formation position is corrected and a color image is formed on the continuous paper. In the case where the determination at step 104 is negative and the pattern image 60 is not detected, the image formation position is corrected on the basis of the correction amount which is calculated based on the detection result of the pattern image 60 the previous time, and a color image is formed on the continuous paper. In the image forming apparatus of the embodiment, when an A4-size color image is to be a one-page color image, color images are formed continuously at a speed of, for example, 460 pages per minute.

Figure 5A:
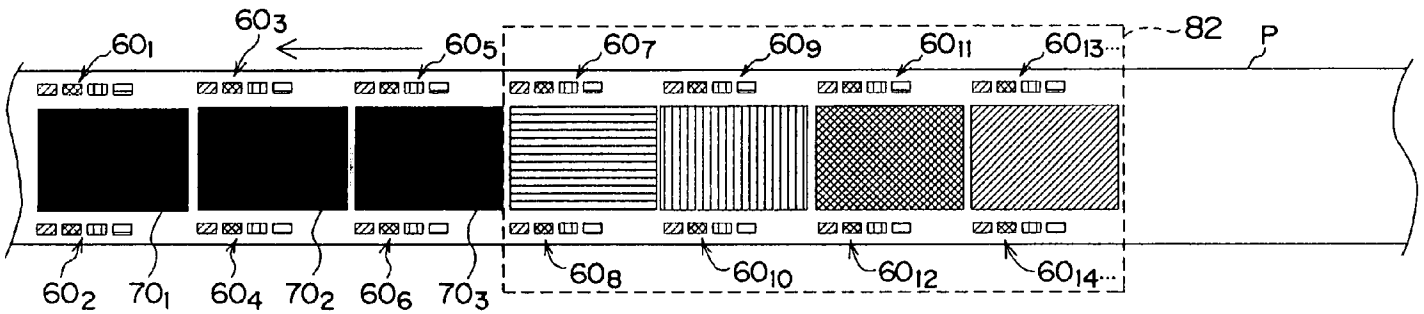
FIG. 5A is a schematic view showing the positions of formed pattern images and color images relative to an image transfer area 82, which are to be formed on a continuous paper at the time of execution of a print job before the continuous paper is back-transported.

By repeatedly executing the processes of steps 102 to 108, for example, as shown in FIG. 5A, plural color images $\mathbf{70}_1$ to $\mathbf{70}_3$ and plural pattern images $\mathbf{60}_1$ to $\mathbf{60}_{14}$ are formed on the continuous paper P. In the example shown in FIG. 5A, a case where the pattern images 60 are formed at both ends of the direction orthogonal to the transport direction of the continuous paper P will be described. The formation positions of the pattern images 60 may be anywhere except for the areas in which the color images 70 are formed and may be at one end in the direction orthogonal to the transport direction of the continuous paper. The detector 27 for detecting the pattern images 60 is provided at a position from which the pattern images 60 can be detected.

At the following step 110, all images based on image data included in an input print job are formed and whether the print job is finished or not is determined. If the determination is negative, the procedure returns to step 102. If the determination is affirmative, the procedure proceeds to step 112.

Figure 5B:
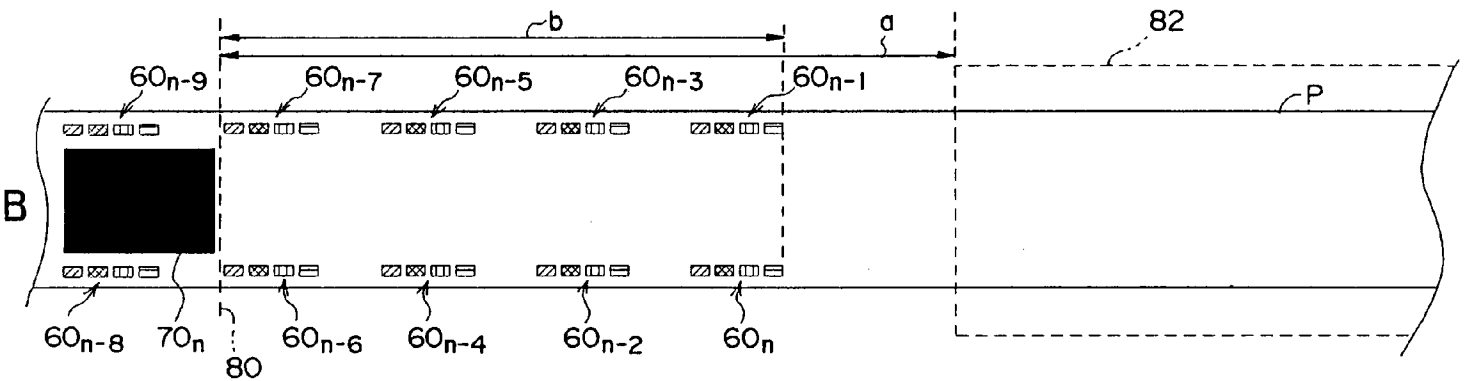
FIG. 5B is a schematic view showing the positions of pattern images and color images relative to the image transfer area 82, which are formed on the continuous paper when transport of the continuous paper is stopped.

At step 112, the process of forming the pattern image 60 formed every predetermined time is stopped. At step 114, transporting of the continuous paper, which is transported in the transport direction, is stopped. Since the continuous paper is transported at high speed before transporting of the continuous paper is stopped, when the end of a print job is determined at step 110 and, after that, transporting of the continuous paper is stopped at step 114, as shown in FIG. 5B, the continuous paper P is in a state where the image formation start position has passed the image transfer region 82 in which a toner image is transferred by the image forming component 64 without forming a color image. On the continuous paper P, pattern images for the next print job are already formed. When formation of an image based on the image data of the next print job is started in the state shown in FIG. 5B, an excessive blank area is produced on the continuous paper.

Figure 5C:
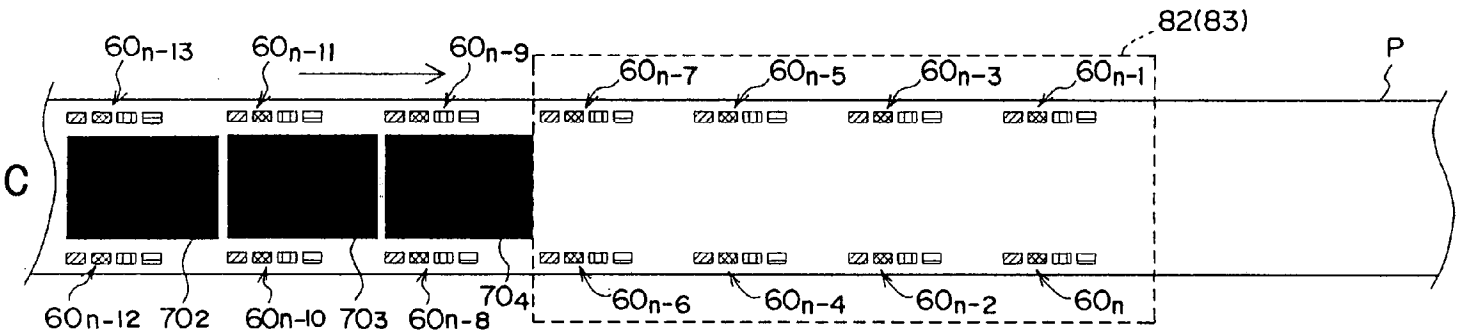
FIG. 5C is a schematic view showing the positions of pattern images and color images, relative to the image transfer area 82 when the continuous paper is back-transported.

At step 116, to suppress formation of an excessive blank area on the continuous paper, the continuous paper P is back-transported only by the back-transport amount stored in the storing component 68. By the process of step 116, as shown in FIG. 5C, the continuous paper is back-transported to the image formation start position of the next print job. By back-transporting the continuous paper only by the back-transport amount, the continuous paper, which is transported to the downstream side in the transport direction of the image transfer area 82 without forming a color image, can be back-transported during the period of from when the end of the print job is determined in the above-described step 110 until the transport of the continuous paper in the transport direction is stopped at step 114. As described above, the continuous paper can be back-transported to the image formation start position of the image data for the next print job. Consequently, when transporting of the continuous paper is temporarily stopped, formation of an excessive blank area on the continuous paper can be suppressed, and waste of the continuous paper can be suppressed.

At step 118, whether the pattern image 60 is already formed or not in a continuous paper back-transported area 83 (refer to FIG. 5C) by the process of the above-described step 116 is determined. If the determination is affirmative, the procedure proceeds to step 120. The determination at step 118 can be done by, for example, storing the formation position or time lapse of the pattern image 60 formed after the end of the job or by making a determination of a detection signal from a sensor which is preliminarily provided at a position corresponding to the formation position of the pattern image 60 on the continuous paper on the upstream side in the transport direction of the image transfer area 82.

Herein, there is a case where the position on the continuous paper transport path after the back-transport has deviated from the original position on the transport path, due to elongation of the continuous paper caused by change with time, or a deviation at the time of transporting of the continuous paper in either the transport direction or in the direction orthogonal to the transport direction. Consequently, if the pattern image 60 formed before the back-transport of the continuous paper is already formed in the continuous paper back-transported area 83 in the process of step 116, then when the image formation position is corrected on the basis of the correction amount calculated based on the result of detection of the pattern image formed before the back-transport of the continuous paper in the continuous paper back-transported area at the time of transporting in the transporting direction after the continuous paper is back-transported, there is the possibility that an erroneous correction is made in the continuous paper back-transported area 83. Also in the case of detecting density, the environment for forming the pattern image 60 before the back-transport of the continuous paper may be different from that of after the back-transport. Similarly, there is the possibility of an erroneous correction being made.

If the pattern image 60 formed before the back-transport of the continuous paper is already formed in the continuous paper back-transported area 83 in the process of step 116, a pattern image is formed so as to overlap the pattern image 60 at the time of transporting in the transport direction after the back-transport of the continuous paper. Consequently, if the image formation position is corrected on the basis of a correction amount calculated based on a result of detection in a state where a pattern image formed before the continuous paper is back-transported and a pattern image formed after the back-transport overlap each other in the continuous paper back-transported area at the time of transporting in the transporting direction after the continuous paper is back-transported, there is the possibility of an erroneous correction being made in the continuous paper back-transported area 83. Also in the case of detecting density, when the pattern images 60 before and after the continuous paper is back-transported overlap each other, there is the possibility of an erroneous correction being made.

At step 120, to inhibit detection of the pattern image 60 formed in the continuous paper back-transported area 83 and on the upstream side in the transport direction of the back-transported area 83, in other words, the pattern images 60 formed before the continuous paper is back-transported, an inhibition time of inhibiting detection of the pattern image 60 is calculated and set as a pattern image detection inhibition time.

The pattern image detection inhibition time is calculated, for example, on the basis of the transport speed of the continuous paper P and the distance from a pattern image $\mathbf{60}_{n-6}$ formed most downstream in the transport direction to a pattern image $\mathbf{60}_{n}$ formed most upstream of all the pattern images 60 formed in the area corresponding to the continuous paper transfer area 82.

On the other hand, when the determination is negative at step 118, the procedure proceeds to step 122 where the pattern image detection inhibition time is set to "0".

When there are no pattern images 60 formed at the time of transporting of the continuous paper before the transporting is stopped in the continuous paper back-transported area 83 by the processes in steps 118, 120, and 122, the pattern image detection inhibition time is set to "0" so as to continuously execute detection of the pattern image 60. When the pattern image 60 formed before the transport is stopped exists in the continuous paper back-transported area 83, the pattern image detection inhibition time is set so as to inhibit detection of the pattern image 60 in the continuous paper back-transported area 83.

At step 124, whether the following print job is received or not is determined. If the determination is affirmative, the procedure proceeds to step 125 where transporting in the transport direction of the continuous paper starts. At the following step 126, counting with the timer 66 starts.

In the above-described step 128, whether the pattern image detection inhibition time, which is set in the above-described step 120 or 122, has elapsed or not is determined by the count value with the timer 66. If the determination is negative, the procedure proceeds to step 130.

At step 130, by correcting the timing for forming an electrostatic latent image of each color with the immediately preceding print job, that is, the correction amount used before the transporting of the continuous paper is stopped, the image formation position is corrected and a color image is formed on the continuous paper. After which, the program returns to step 128. Alternately, the correction may not be made at step 130.

If the determination is affirmative at step 128, the procedure proceeds to step 132 where counting with the timer 66 is reset. After which, the procedure proceeds to step 134 where formation of a pattern image is started, correction based on the correction amount is made, and a color image is formed on the continuous paper P in a manner similar to the above-described steps 102 to 108.

At step 136, in a manner similar to the above-described step 110, whether the print job has been finished or not is determined. If the determination is negative, the procedure returns to step 102. If the determination is affirmative, the procedure proceeds to step 138. At step 138, whether a signal indicative of the end of the image forming process with the image forming apparatus 10 is received or not is determined. If the determination is negative, the procedure returns to step 112. If the determination is affirmative, the routine is finished. The signal indicative of the end of the image forming process is input by an operation instruction from an operating component by a user.

As described above, in the image forming apparatus 10 of the embodiment, when the print job is finished, transporting of the continuous paper is stopped, and the continuous paper is back-transported to the image formation start position of the following print job. After which, when the following print job is executed, if there is a pattern image in the continuous paper back-transported area, at least one of the image formation position and the density is corrected in accordance with the correction amount computed before the continuous paper is back-transported or at least one of the image formation position and the density is not corrected. Consequently, even if the pattern image forming conditions change before and after the continuous paper is back-transported due to elongation of the continuous paper caused by a change with time, a shift of the continuous paper, or a change in the pattern image formation environment before and after the continuous paper is back-transported, an erroneous correction at the time of executing a print job after the continuous paper is back-transported can be suppressed.

Therefore, an erroneous correction of the image formation position after the continuous paper is back-transported can be suppressed.

At the time of execution of the following print job, in the area on the continuous paper where the pattern image corresponding to the immediately preceding print job is formed, a pattern image corresponding to the following print job is not formed but the image formation position is corrected with the correction amount used at the time of executing the immediately preceding print job. Thus, the amount of toner consumed can be suppressed.

In the embodiment, the case where a correction amount is calculated for correcting the image formation position of an image of each color has been described. It is also possible to calculate a correction amount for adjusting the density of an image of each color to correct variations of the density. In this case, it is sufficient to calculate a correction amount for making a correction such that, for example, the density of each of the pattern images 60Y, 60M, 60C, and 60K becomes the same as a predetermined reference density corresponding to the pattern image of each color. Alternately, both the position and density may be corrected. In the case of adjusting density, it is sufficient to adjust the exposure amount of each of the LED heads 32Y, 32M, 32C, and 32K. As other density adjusting methods, development bias, charging voltage, a tone image signal, or the like may be adjusted.

Furthermore, in the embodiment, the case of stopping transporting of the continuous paper, then transporting the continuous paper in the direction opposite to the transport direction to the image formation start position of the next print job, and correcting the image formation position in accordance with a correction amount computed before the continuous paper is back-transported at the time of executing the next print job has been described. However, the method for suppressing an erroneous correction by detecting a pattern image according to the immediately preceding print job is not limited to the foregoing embodiment and may be executed as follows.

That is, the back-transport amount of the continuous paper after transporting of the continuous paper is stopped may be set to an amount by which a pattern image corresponding to the next print job is formed on the upstream side in the transport direction of the pattern image formed last on the continuous paper of all the pattern images according to the immediately preceding print job.

Figure 6A:
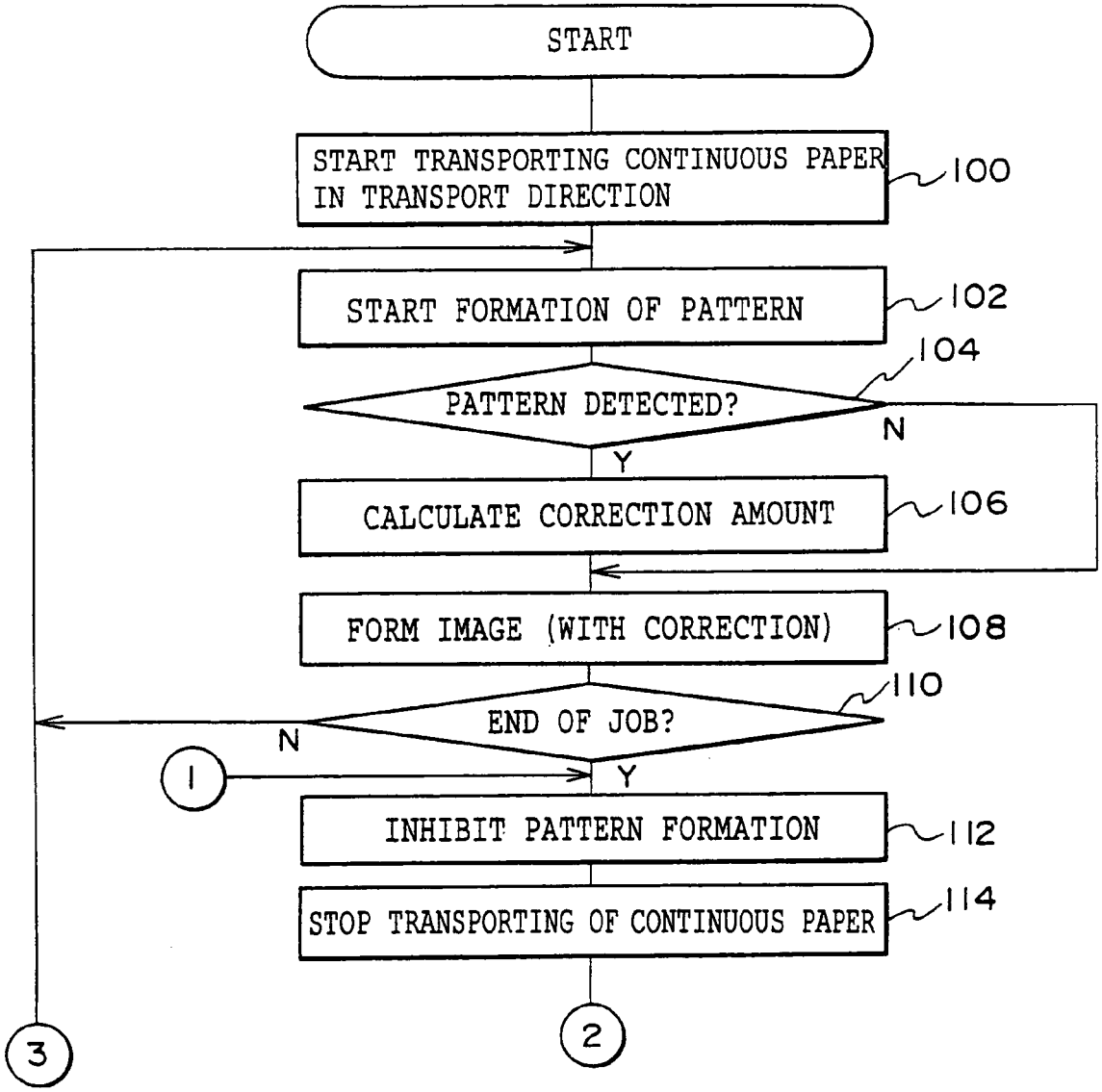
FIGS. 6A and 6B are flowcharts showing the flow of processes executed by a control component in the case where a back-transport amount of the continuous paper is set so that a pattern image corresponding to the next print job is formed from the upstream side in the transport direction of a pattern image formed last on the continuous paper among the pattern images according to the immediately preceding print job.
Figure 6B:
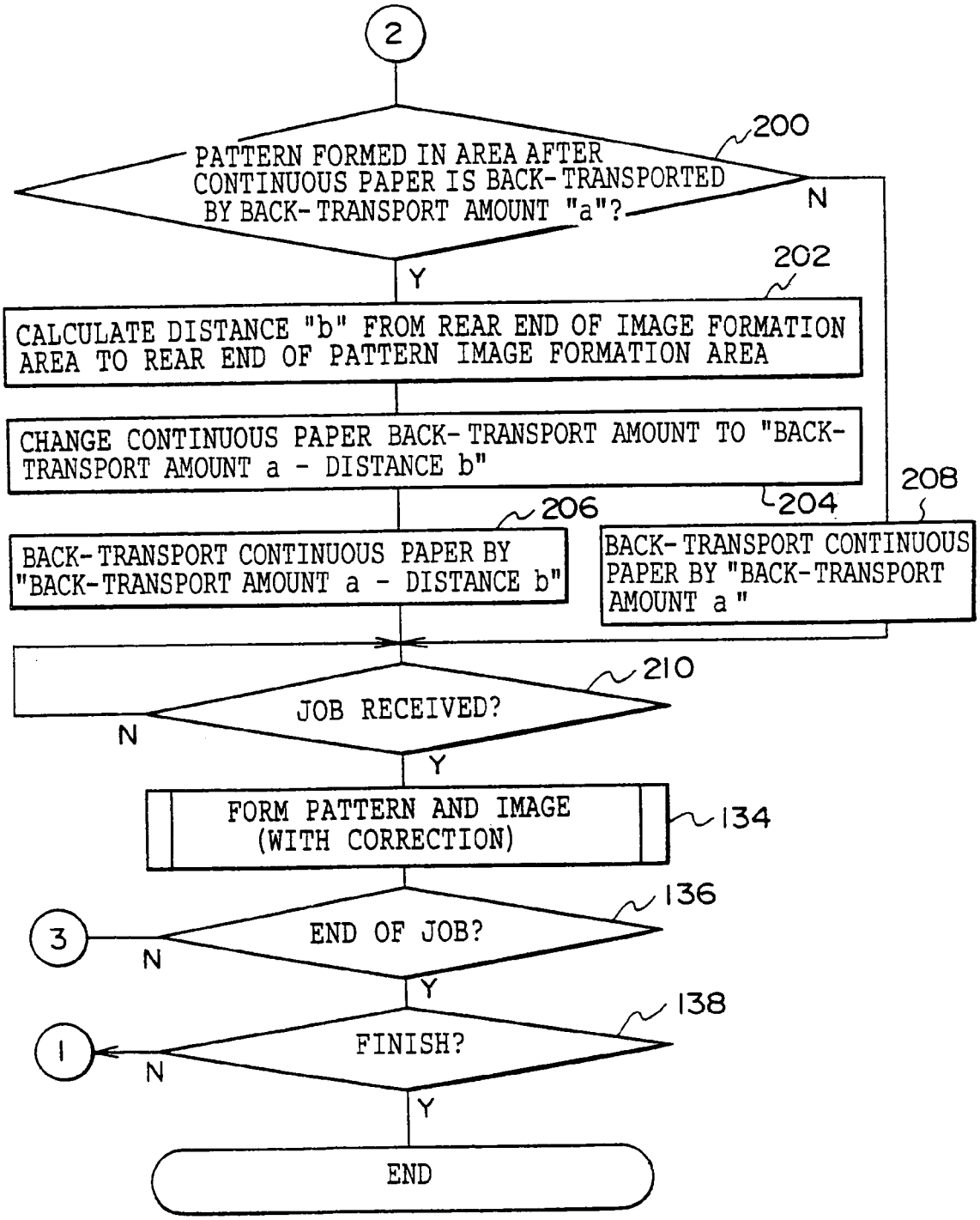

In this case, for example, as shown in FIGS. 6A and 6B, in the control component 61, processes similar to the above-described steps 100 to 114 are performed and transporting in the transport direction of the continuous paper is stopped. After which, the procedure proceeds to step 200 and it is determined whether the pattern image 60 is already formed or not in the area on the continuous paper corresponding to the image transfer area 82 obtained when the continuous paper is back-transported in the direction opposite to the transport direction only by the back-transport amount stored in the storing component 68. If the determination is negative, the procedure proceeds to step 208 where the continuous paper is back-transported in the direction opposite to the transport direction only by the back-transport amount stored in the storing component 68. Thereafter, the procedure proceeds to step 210.

On the other hand, if the determination is affirmative at step 200, the procedure proceeds to step 202 and, as shown in FIG. 5B, distance "b" from the edge on the upstream side of a color image formed on the most upstream side in the transport direction on the continuous paper P to the edge on the most upstream side of the pattern image 60 corresponding to the immediately preceding print job formed on the most upstream side in the transport direction on the continuous paper P is calculated.

Next, at step 204, as shown in FIG. 5B, a value obtained by subtracting the distance "b" calculated in step 202 from a back-transport amount "a" stored in the storing component 68 is newly set as a back-transport amount of the continuous paper. At the next step 206, the continuous paper is back-transported only by the newly set back-transport amount.

At the next step 210, a negative determination repeats until the next print job is received in a manner similar to the next step 134. When a positive determination is made, then in a manner similar to the next steps 134 to 138, a process of forming the pattern image 60 corresponding to the next print job and forming an image based on image data included in the print job is repeatedly executed until the print job is finished and an instruction for ending image formation is given. After which, the routine is finished.

As described, when transporting of the continuous paper is stopped and the continuous paper is back-transported in the direction opposite to the transport direction, the continuous paper back-transport amount is set so that a pattern image corresponding to the next print job is formed from the upstream side in the transport direction of the pattern image formed last on the continuous paper of all the pattern images corresponding to the immediately preceding print job. Consequently, pattern images can be formed so as not to overlap on a print job unit basis without needing to be aware of the position of the pattern image generated before the continuous paper is back-transported. The amount of shift of the pattern image corresponding to the immediately preceding print job can be prevented from being detected at the time of execution of the following print job, and erroneous correction of the image formation position after the continuous paper is back-transported can be suppressed.

Furthermore, although the case of inhibiting formation of a pattern image corresponding to the next print job in an area on a continuous paper in which a pattern image is formed corresponding to the immediately preceding print job executed before the continuous paper is stopped at the time of executing the next print job has been described in the foregoing embodiments, the pattern image corresponding to the next print job may be formed so as not to overlap a pattern image corresponding to the immediately preceding print job in the area.

Figure 7A:
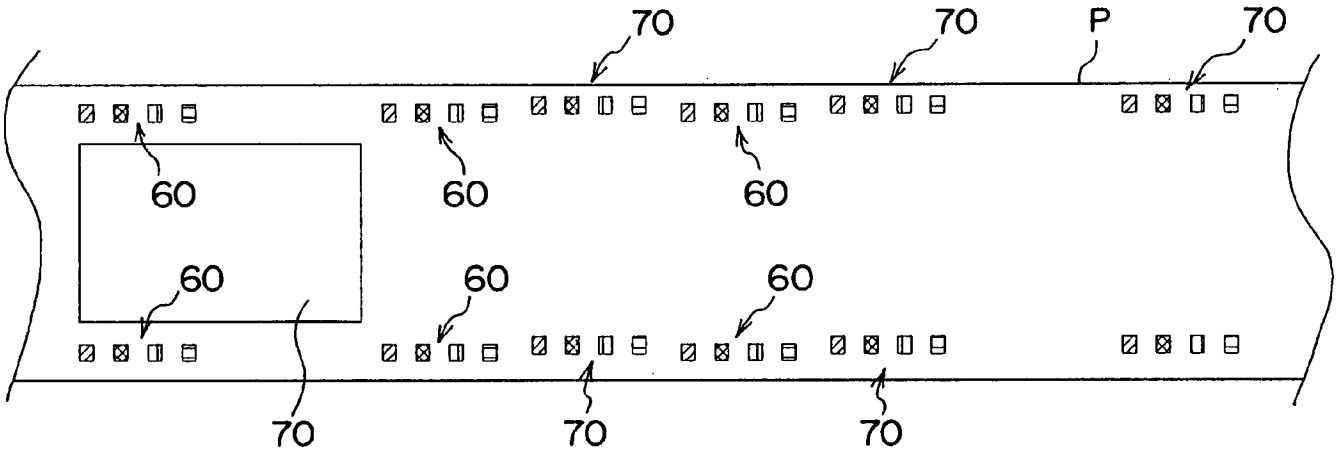
FIG. 7A is a schematic view showing pattern images 70 corresponding to the next print job, which are formed in positions so as not to overlap pattern images 60 corresponding to the immediately preceding print job, which is the case when the pattern images 70 are formed so as not to overlap the pattern images 60 on the upstream side in the transport direction of the pattern images 60.
Figure 7B:
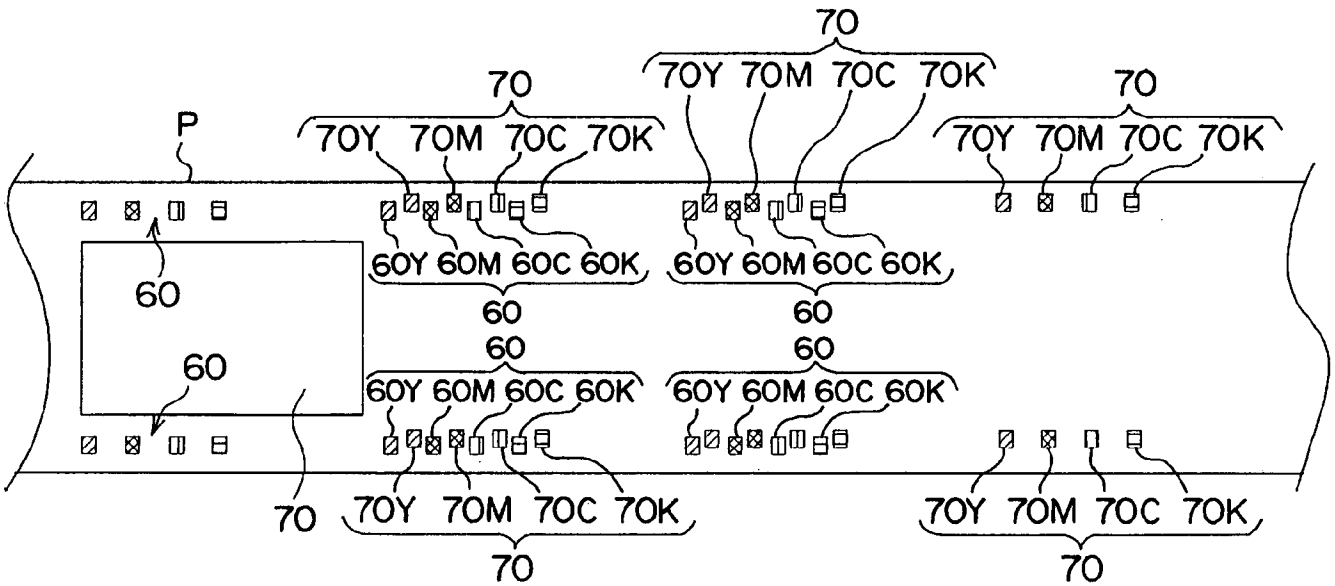
FIG. 7B is a schematic view showing pattern images 70 corresponding to the next print job, which are formed in positions so as not to overlap the pattern images 60 corresponding to the immediately preceding print job, which is the case when the pattern images 70 are formed so as not to overlap the pattern images 60 in the direction orthogonal to the transport direction of the pattern images 60.

Specifically, as shown in FIGS. 7A and 7B, the pattern images 70 corresponding to the next print job are formed so as not to overlap the pattern images 60 corresponding to the immediately preceding print job. At the time of executing the next print job, a correction amount is calculated on the basis of the result of detection of the pattern images 70 and the image formation position is corrected. Consequently, when transporting of the continuous paper is stopped on completion of a print job, and the continuous paper is back-transported to the image formation start position of the next print job and, after which, the next print job is executed, the image formation position is corrected with a correction amount computed on the basis of a result from a detection of the shift amount of the pattern image corresponding to the next print job. Consequently, the image formation position can also be properly corrected at the time of executing the print job after the continuous paper is back-transported.

Although a rectangular pattern is used as the pattern image in all of the foregoing embodiments, the invention is not limited to the rectangular pattern. As long as the image formation position and density can be detected, any pattern may be employed.

Although the example of forming pattern images on every page has been described in all of the foregoing embodiments, the invention is not limited to the example. The pattern images may be formed every predetermined number of pages or at the end of a job.

Although the example of stopping the image forming process when the end of a job is determined and stopping the transporting of a continuous paper has been described in all of the foregoing embodiments, the invention is not limited to the example. It is also possible to determine formation of no images due to a data transfer delay or the like.

Although the plural image forming components are included in all of the foregoing embodiments, the invention is not limited to plural image forming components. One image forming component may be included.

As described above, an image forming apparatus of a first aspect of the invention includes: a transporting component for transporting a continuous paper at a predetermined transport speed; plural image forming components which are arranged along the transport direction of the continuous paper transported by the transporting component and sequentially form images of respective colors based on image data included in a print job on the continuous paper being transported; a pattern image forming component for controlling the image forming components such that pattern images of respective colors are formed on the continuous paper being transported; a correction amount computing component for detecting a shift amount of at least one of the position and the density of the pattern images of the different colors formed on the continuous paper during transporting and computing a correction amount for correcting at least one of a formation position and density of images of the different colors on the basis of the detected shift amount; an image formation controlling component for controlling the image forming components such that at least one of the image formation position and density is corrected by using the correction amount computed by the correction amount computing component; a transport control component for controlling the transporting component such that transporting of the continuous paper is stopped when a print job is finished, the continuous paper is back-transported to an image formation start position of the next print job, and after which, the continuous paper is transported again; and a control component that, when a print job is executed in the case where a pattern image exists in a back-transported area which is set after the continuous paper is back-transported, controls the image formation controlling component so as not to correct at least one of the image formation position and the density, or so as to correct at least one of the image formation position and the density by using a correction amount used for the immediately preceding print job.

In the image forming apparatus of the first aspect, the control component can control the pattern image forming component so as to inhibit formation of the pattern image in a non-image area spanning from the last image formation area based on the image data to the image formation start position of the next print job.

Consequently, when there is a pattern image formed before the continuous paper is back-transported, in a non-image area in a back-transported area extending from the last image formation area based on the image data to the image formation start position of the next print job, then by inhibiting formation of a pattern image in this area, a pattern image does not overlap the area in which the pattern image exists formed before the continuous paper is back-transported, and the amount of materials consumed such as toner and ink used for forming a pattern image can be suppressed.

What is claimed is:

1. An image forming apparatus comprising:

a transporting component that transports a continuous paper at a predetermined transport speed;

one or more image forming components which are arranged along the transport direction of the continuous paper transported by the transporting component and sequentially form images of respective colors based on image data included in a print job on the continuous paper being transported;

a pattern image forming component that controls the image forming components so that pattern images of respective colors are formed on the continuous paper being transported;

a correction amount computing component that detects a shift amount of at least one of the position and the density of the pattern images of the different colors formed on the continuous paper during transporting and computes a correction amount for correcting at least one of a formation position and density of images of the different colors on the basis of the detected shift amount;

an image formation controlling component that controls the image forming components so that at least one of the image formation position and the density is corrected by using the correction amount computed by the correction amount computing component;

a transport control component that controls the transporting component so that transporting of the continuous paper is stopped when a print job is finished, the continuous paper is back-transported to an image formation start position of the next print job, and after that, the continuous paper is transported again; and a control component that, when a print job is executed in the case where a pattern image exists in a back-transported area which is set after the continuous paper is back-transported, controls the image formation controlling component so as not to correct at least one of the image formation position and the density or so as to correct at least one of the image formation position and the density by using a correction amount used for the immediately preceding print job.

2. The image forming apparatus of claim 1, wherein the control component controls the pattern image forming component so as to inhibit formation of the pattern image in a non-image area from the last image formation area based on the image data to the image formation start position of the next print job.

3. An image forming apparatus comprising:

a transporting component that transports a continuous paper at a predetermined transport speed;

one or more image forming components which are arranged along the transport direction of the continuous paper transported by the transporting component and sequentially form images of respective colors based on image data included in a print job on the continuous paper being transported;

a pattern image forming component that controls the image forming components so that pattern images of respective colors are formed on the continuous paper being transported;

a correction amount computing component that detects a shift amount of at least one of the position and the density of the pattern images of the different colors formed on the continuous paper during transporting and computes a correction amount for correcting at least one of a formation position and density of images of the different colors on the basis of the detected shift amount;

an image formation controlling component that controls the image forming components so that at least one of the image formation position and the density is corrected by using the correction amount computed by the correction amount computing component;

a transport control component that controls the transporting component so that transporting of the continuous paper is stopped when a print job is finished, the continuous paper is back-transported to an image formation start position of the next print job, and after that, the continuous paper is transported again;

a pattern image formation control component that, when a print job is executed in the case where a pattern image exists in a back-transported area which is set after the continuous paper is back-transported, controls the pattern image forming component so that a pattern image formed after the continuous paper is back-transported and a pattern image formed before the continuous paper is back-transported do not overlap each other; and a computation control component that, after the continuous paper is back-transported, controls the correction amount computing component so as to detect a shift amount of at least one of the position and the density of pattern images formed after the continuous paper is back-transported.

4. An image forming apparatus comprising:

a transporting component that transports a continuous paper at a predetermined transport speed;

one or more image forming components which are arranged along the transport direction of the continuous paper transported by the transporting component and sequentially form images of respective colors based on image data included in a print job on the continuous paper being transported;

a pattern image forming component that controls the image forming components so that pattern images of respective colors are formed on the continuous paper being transported;

a correction amount computing component that detects a shift amount of at least one of the position and the density of the pattern images of the different colors formed on the continuous paper during transporting and computes a correction amount for correcting at least one of a formation position and density of images of the different colors on the basis of the detected shift amount;

an image formation controlling component that controls the image forming components so that at least one of the image formation position and the density is corrected by using the correction amount computed by the correction amount computing component;

a transport control component that controls the transporting component so that transporting of the continuous paper is stopped when a print job is finished, the continuous paper is back-transported to an image formation start position of the next print job, and after that, the continuous paper is transported again; and a back-transport amount control component that controls the transport control component so that a back-transport amount of the continuous paper is set according to the presence or absence of a pattern image formed or a pattern image position.

* * * * *